United States Patent [19]

Lugiewicz

[11] Patent Number: 4,969,649

[45] Date of Patent: Nov. 13, 1990

[54] PERFORMANCE ENHANCEMENT APPARATUS

[76] Inventor: Robert C. Lugiewicz, 18479 Toledo Blade Blvd., Port Charlotte, Fla. 33948

[21] Appl. No.: 300,498

[22] Filed: Jan. 23, 1989

[51] Int. Cl.[5] ..... A63B 69/36

[52] U.S. Cl. ..... 273/183 B; 273/190 A

[58] Field of Search ..... 273/183 B, 190 A, 183 E, 273/29 A, 26 C

[56] References Cited

U.S. PATENT DOCUMENTS

| | | | |
|---|---|---|---|
| 2,433,590 | 12/1947 | Barr | 273/190 A |
| 3,228,696 | 1/1966 | Hull | 273/183 B |
| 4,392,650 | 7/1983 | Hilton | 273/190 A |

*Primary Examiner*—George J. Marlo

*Attorney, Agent, or Firm*—Gifford, Groh, Sprinkle, Patmore and Anderson

[57] ABSTRACT

A performance enhancement aid for sports activities and the like in which it is necessary to keep the eyes focused on a target. The aid may be an assembly which is mounted on the user's eyeglasses or the eye direction panels may be permanently fixed to a frame which is worn on the head in a manner similar to eyeglasses. A pair of opaque panels are supported on opposite sides of the user's eyes. Each panel has a forward portion which extends obliquely inwardly toward and aligned with the optical axis line of the adjacent eye when the user's eyes are focused on a target. Each oblique extension defines a desired sight line. The two defined sight lines converge at a line bisecting the angle formed by the optical axis lines of the user's eyes, thereby directing the user's eyes to the target.

17 Claims, 2 Drawing Sheets

PERFORMANCE ENHANCEMENT APPARATUS

BACKGROUND OF THE INVENTION

1. Field of the Invention.

This invention relates generally to performance enhancement apparatus for sports activities and the like, and more particularly to training aids for directing user's eyes to a target and enabling concentration to be practiced and maintained.

2. Description of the Prior Art.

The prior art includes several forms of blinder or eye shade devices which may be employed on or about a person's head to carry out their intended functions.

For example, U.S. Pat. No. 3,874,672 discloses a golfer's training aid in the form of a blinder which is a plate pivotally coupled to a headband. The plate is opaque in order to generally block the golfer's vision to one side and intended to make him concentrate on striking the golf ball. The plate is simply used to block peripheral vision and is not aligned in any particular manner.

U.S. Pat. No. 4,298,991 discloses two such peripheral blinders, the novelty being in the sliding attachment to a frame. Again, there is no plate alignment taught.

U.S. Pat. No. 4,321,708 discloses a golf hat having blinders secured to the visor which are pivotable downward to block peripheral vision, with no particular alignment of the blinders discussed.

U.S. Pat. No. 3,226,729 discloses tinted sun shields on each side of a user's head. The shields are curved for rigidity and to allow circulation of air between the shields and the head. No alignment is discussed.

This invention differs from the many side mounted sunglass accessories and simple peripheral vision blocking blinders in that opaque panels at the side of each eye are extended obliquely inwardly toward and aligned with the optical axis line of the adjacent eye when the user's eyes are focused on a target, thereby directing the user's eyes to the target focal point and discouraging movement of the head which would move the eyes away from the focal point. An initial prototype of this invention is shown in Disclosure Document No. 183,444, dated Dec. 28, 1987 by the U.S. Pat. Office.

Such a device has application in many areas. In golf, the target may be the back portion of the ball, the exact portion depending upon whether the golfer wishes to hook or slice the ball. In bowling, the target may be the selected spot or target arrow on the lane, or the pocket between two pins. In archery, the target is the bull's-eye. Any task requiring continued focus on a target would be helped, whether a sport or another activity.

SUMMARY OF THE INVENTION

This invention discloses a performance enhancement assembly for directing user's eyes to a target and includes a pair of opaque panels adapted to be supported at eye level on the head of a user, with the panels to be disposed on opposite sides of the user's head adjacent to and alongside of each eye.

Each panel extends forward from a position substantially even with its adjacent eye and also extends obliquely inwardly toward and aligned with the optical axis line of the adjacent eye when the user's eyes are focused on a target. This directs the user's eyes to the target focal point and discourages unwanted body and head movement. Means are provided for securing the panels to a support to be placed on the user's head.

In the preferred embodiment each panel's oblique extension defines a desired sight line when the user's eyes are focused on a target. The sight lines of the two panels preferably converge at a line bisecting the angle formed by the optical axis lines of the user's eyes.

The point of convergence of the two defined sight lines may be modified, depending upon the acuity of the user's vision, whether or not correction is needed, the type of correction, difference in vision of the two eyes, and which convergence point is the most comfortable for and effective with a particular individual. For some users, the convergence point of the two defined sight lines may be at the target itself. For others, the convergence point may be on the bisecting line between the target and the user's eyes, or on the bisecting line after it passes through the target.

The assembly also preferably includes an auxiliary opaque panel member extending inwardly from the first-mentioned panel toward the user's head to block visual distractions above the eye level of the user. Further, each first-mentioned opaque panel member also extends rearwardly to block peripheral visual distractions.

The main opaque panels may be flat, may have an cross-section curving around an adjacent optical axis line to further reduce visual distractions above and below the optical axis lines, or may have complex curves to aid in directing the eyes to the target.

A frame support means may be provided for holding the panels in the eye adjacent position. Such a frame may include a bridge section adapted to rest on the user's nose. Temple pieces are pivotally attached to and extend rearwardly from each end of the bridge section to rest on the user's ears. The bridge section and temple pieces cooperate to retain the frame on the user's head.

Each opaque panel may be secured to its corresponding temple piece so that the panels are moved into a storage position when the temples are pivoted toward each other to a closed position next to the bridge section.

The opaque panels may also be adjustably secured to a frame, to enable a panel sight line adjustment to accommodate different users or different activities, e.g., a target at a different distance from the eyes, if desirable or necessary. The adjustable securing means may include a first pivotal means for connecting a panel to a support, and a second pivotal means which includes means for selectively securing the panel in a desired pivoted position with respect to the support to retain the panel in the selected panel sight line position.

The panel securing means may also be means for removably securing each panel to a pair of eyeglasses, so that users with prescription lens or favored sunglasses may use a clip-on approach. This clip-on approach may also have means for adjusting the position of the panels to obtain different panel sight line positions to accommodate different users or activities. For example, this might include a first pivotal means for connecting a panel to a pair of glasses, and a second pivotal means for connecting the panel to the glasses which includes means for selectively securing the panel in a desired pivoted position with respect to the pair of glasses, thus enabling retention of the panel in a selected panel sight line position.

It is an object of the above described invention to provide an improved performance enhancement apparatus or training aid.

It is a further object of this invention to provide such an apparatus or aid which uses opaque panels to define sight lines to direct the user's eyes to a target.

A still further object is to provide an improved apparatus or aid which may be adjusted for different users or activities.

Other objects, advantages and features of the invention will become apparent when the following description is taken in conjunction with the accompanying drawings.

BRIEF DESCRIPTION OF THE DRAWINGS

In the drawings, where like numerals are employed to designate like parts throughout.

DESCRIPTION OF THE PREFERRED EMBODIMENTS

Figure 1:
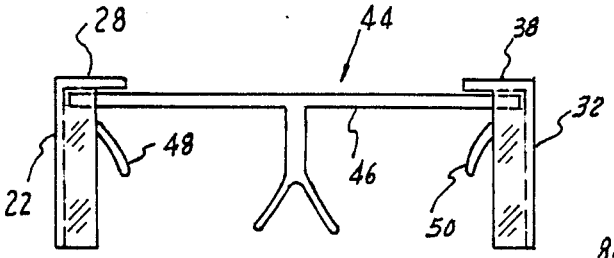
FIG. 1 is a front elevational view of an apparatus or aid embodying the teachings of this invention.
Figure 2:
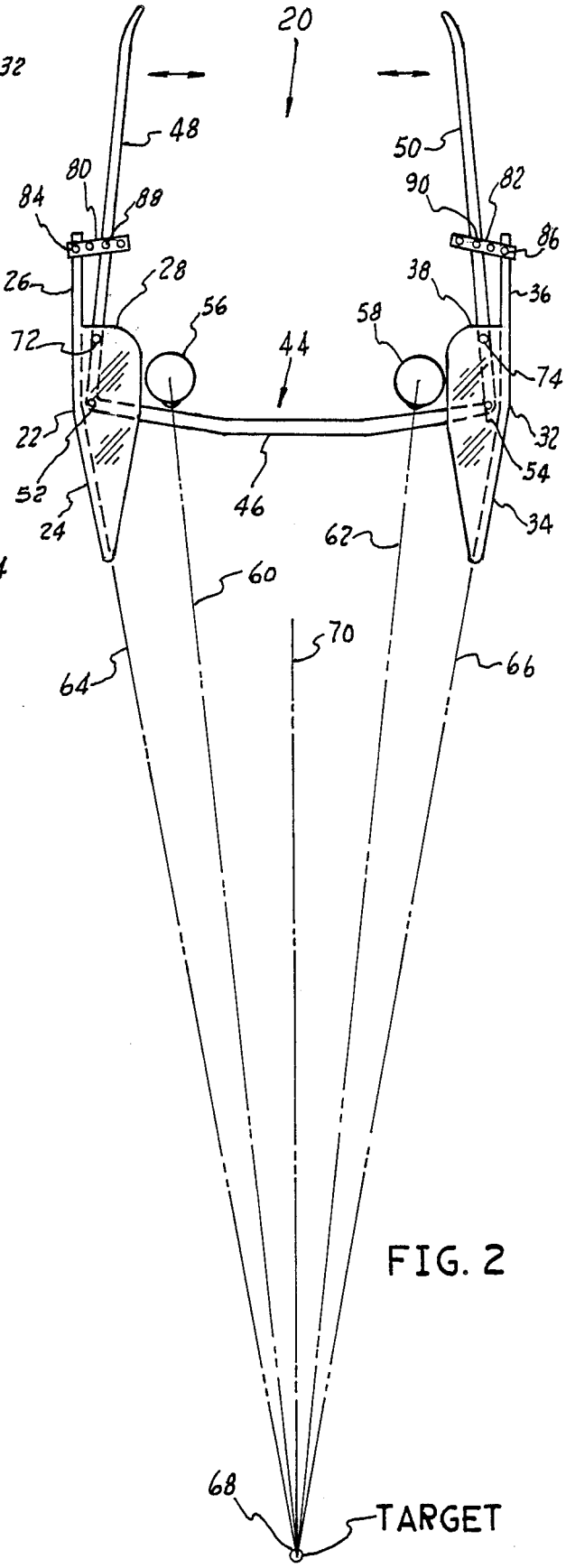
FIG. 2 is a plan view of the device of FIG. 1, with diagrammatic illustration of the operation of the device.

Referring now to FIGS. 1 and 2 there is illustrated an apparatus or aid generally indicated at 20 which embodies the teachings of this invention.

A pair of opaque panels 22 and 32 are mounted on a frame 44 which includes a bridge section 46 and temple pieces 48, 50 extending rearwardly from each end of bridge section 46. The temples 48, 50 are pivotably connected at 52, 54 respectively to the bridge section 46. The temple pieces and bridge section cooperate to retain the frame 44 on the user's head.

The frame 44 supports the opaque panels 22, 32 at eye level on the head of a user, with the panels adjacent to and alongside of each eye.

Each panel 22, 32 has a forward portion 24, 34 and a rear portion 26, 36, respectively. The forward portions 24, 34 extend forward from a position substantially even with its adjacent eye 56, 58, respectively, and also extends obliquely inwardly toward and aligned with the optical axis line 60, 62 of the adjacent eye 56, 58 when the user's eyes are focused on a target 68. The optic axis is the axis of the eye corresponding with the line of vision passing through the center of the lens and cornea. Thus, the optic axis line is the extension of the optic axis to a target. The forward portions 24, 34 thus direct the user's eyes 56, 58 to the target 68 and discourage movement of the head which would move the eyes away from the target focal point. The oblique extension of each panel's forward portion 24, 34 defines a desired sight line 64, 66 when the user's eyes are focused on target 68, whereby the sight lines 64, 66 converge at a line 70 bisecting the angle formed by the optical axis lines 60, 62.

Figure 8:
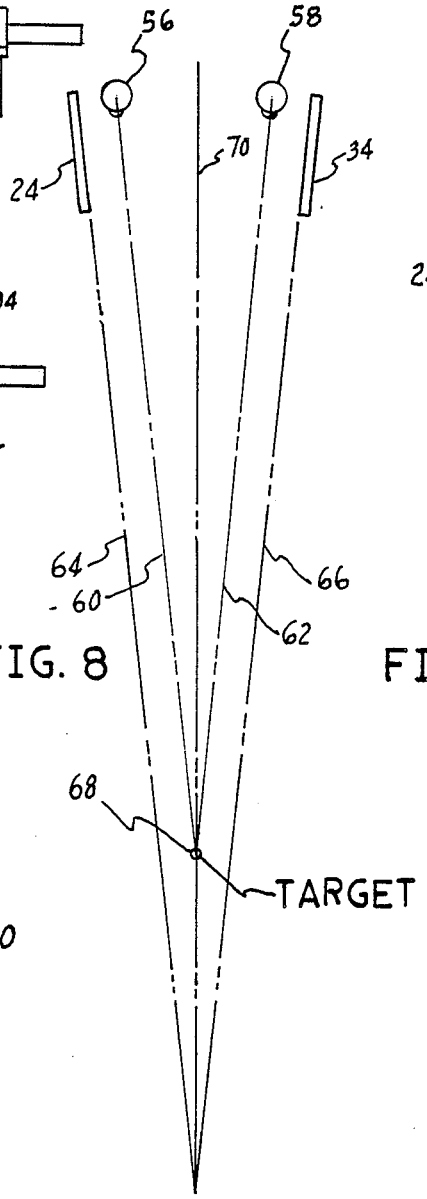
FIGS. 8 and 9 are diagrammatic views of alternative panel sight line setups for the invention.

As discussed hereinbefore, it is suggested that for a user with normal vision the convergence of sight lines 64, 66 be set at the target 68. However, differences in the vision or the comfort factor for different users might make it desirable for the convergence of sight lines 64, 66 to occur on the bisecting line 70 before line 70 reaches target 68 (FIG. 9), or after line 70 passes through target 68 (FIG. 8).

In referring to line 70 as bisecting the angle formed by optical axis lines 60, 62, it is intended to cover the case where the line 70 is drawn between the target and a point midway between the eyes 56, 58.

Figure 9:
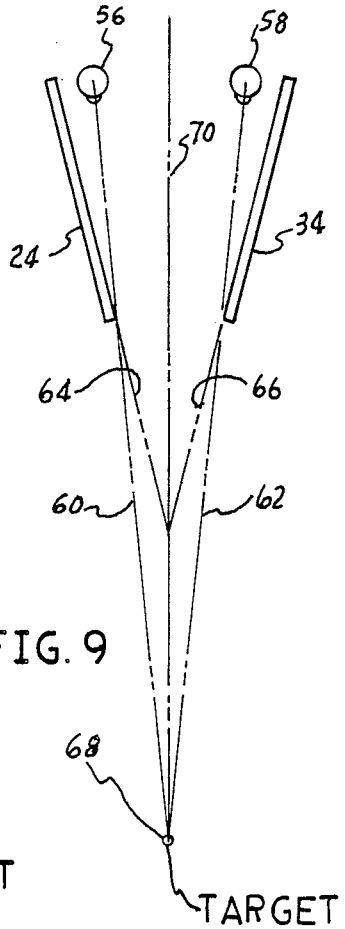

It should also be noted that FIG. 9 illustrates another embodiment of the invention in which forward panel portions 24, 34 have been extended to the edge of optical axis lines 60, 62 to further direct the eyes to target 68, since the target will go out of view of one eye when the head is rotated.

As best seen in FIG. 2, the opaque panels 22, 32 also include rearwardly extending portions 26, 36 which block visual distractions from the side. Auxiliary panel portions 28, 38 extend inwardly from and above each of the main panels 22, 32 toward the user's head to block visual distractions above the eye level of the user.

FIG. 2 also illustrates different ways to attach the panels 22, 32 to the frame 44. The auxiliary panels 28, 38 may be permanently secured to temple pieces 48, 50 at 72, 74 by screws, studs, glue, etc. Thus, the panels 28, 38 are moved into a storage position for insertion into a case when the temples 48, 50 are pivoted toward each other to a closed position next to bridge section 46.

Alternatively, the fixed securing means at 72, 74 may be omitted and the panels 22, 32 mounted to enable adjustment. Again referring to FIG. 2, the auxiliary panels 28, 38 may be pivotally mounted to the frame 44 at 52, 54. Adjustable connecting pieces 80, 82 may be pivotally connected at 84, 86 to the upper edge of panel rear portions 26, 36. The connecting pieces 80, 82 may then be selectively connected to temples 48, 50 at 88, 90 by a press-fit stud/hole connection, one of the plurality of holes formed in each of the connectors 80, 82 being selected to rotate panels 22, 32 to the desired position to define a desired sight line 64, 66 position. Thus, the position of panels 22, 32 and sight lines 60, 62 may be changed to accommodate different users or activities, e.g., when the target in a new activity is closer or further away than the target in a previous activity.

Figure 3:
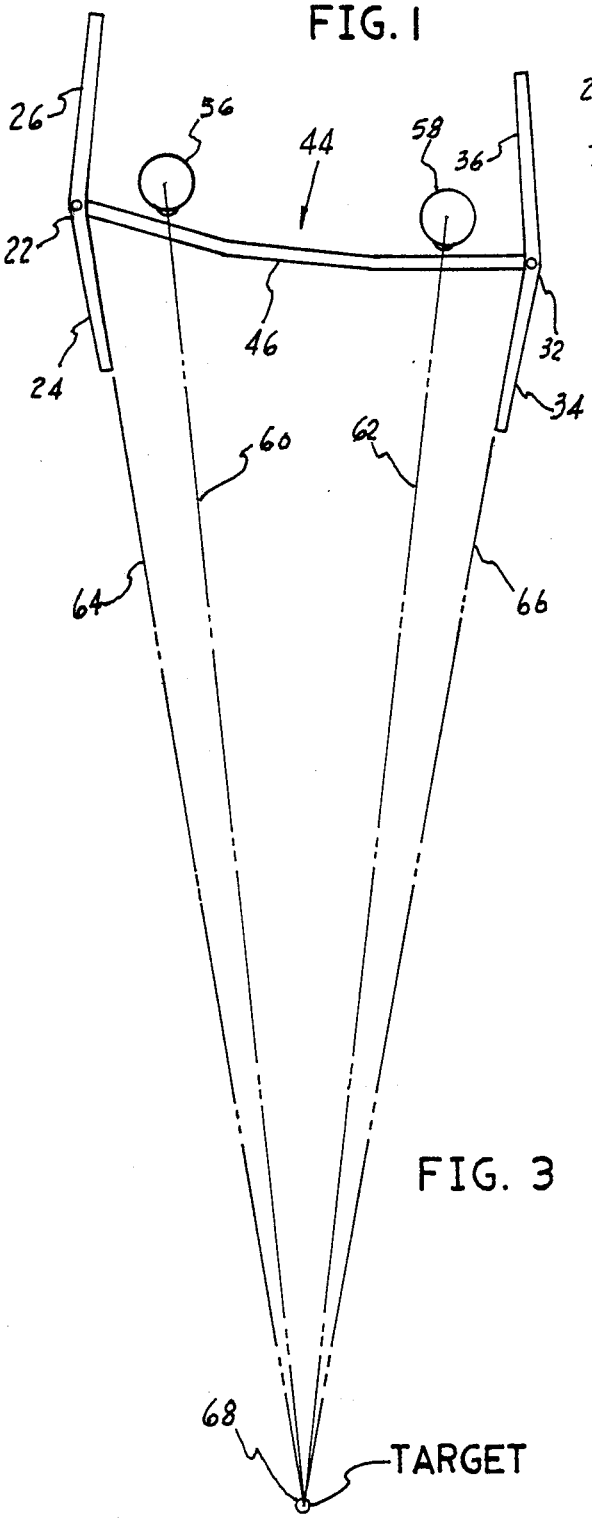
FIG. 3 is a diagrammatic representation of an adjusted device.

Referring now to FIG. 3, there is illustrated a different use for the adjustable connecting means just described. Some golfers prefer to pre-cock their head to the rear by rotating their chin out of the way of their shoulder before initiating their backswing. As shown in FIG. 3, the user has rotated his head clockwise to a pre-swing position. If the opaque panels 22, 32 were fixed to the frame 44 they would then direct the golfer's eyes to a position too far behind the ball. By adjusting the panels 22, 32 as shown in FIG. 3 so that the defined sight lines 64, 66 converge at target 68, the golfer's eyes are directed at the target after the head is pre-cocked.

Figure 4:
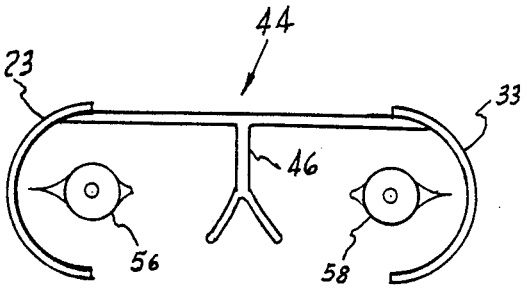
FIG. 4 is a diagrammatic front view of a second embodiment of the teachings of this invention.

Referring now to FIG. 4, the front view illustrates opaque panels 23, 33 that are arcuate in cross-section. In the form shown the cross-section is a semi-circle, while the extended panel would be in the form of half of a hollow right circular cylinder. In this instance the sight lines would be defined along the inside of the hollow cylinder half at the eye level of the user. The panels curve around on adjacent optical axis line to further enhance eye directing. Visual distractions above and below the optical axis lines are also further reduced. It should be noted that although only flat and semi-circular embodiments are shown, it is obvious that other geometric configurations might be used.

Figure 5:
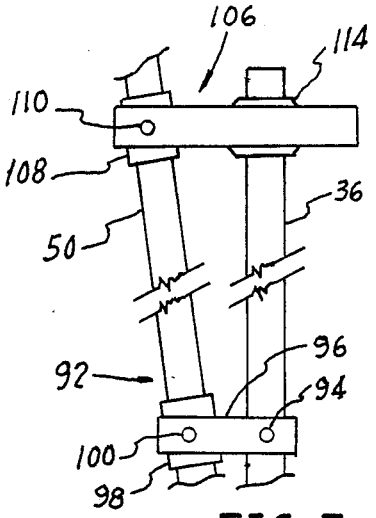
FIG. 5 is a plan view of an adjustable clip-on means.
Figure 6:
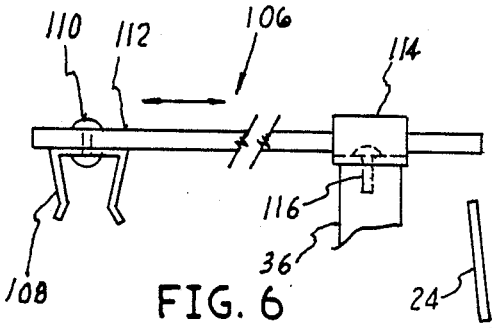
FIGS. 6 and 7 are enlarged frontal views of parts of the device of FIG. 5.
Figure 7:
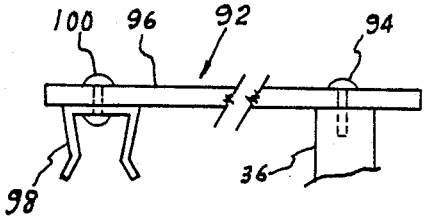

Referring now to FIGS. 5, 6 and 7 there is illustrated means for removably securing the opaque panels 22, 32 to a user's prescription, sun, or other personal eyeglasses. A first pivotal means indicated generally at 92 includes pivot means 94 for pivotally securing a connecting member 96 to a rear portion 36 of a panel 32. The other end of member 96 carries a spring clip 98 pivotally connected to member 96 at 100. Spring clip 98 engages temple piece 50 to enable pivotal attachment of panel 32 to temple piece 50.

An adjustable connecting means is indicated at 106 and includes a spring clip 108 which is attachable to temple 50 and is pivotally connected at 110 to connecting member 112. A spring clip 114 is pivotally connected to rear panel portion 36 at 116 (FIG. 6). The spring clip 114 receives the connecting member 112 and tightly engages member 112 to hold the rear panel portion 36 in a selected spaced position from temple piece 50 to retain the forward portion 34 in the desired sight line position.

Figure 10:
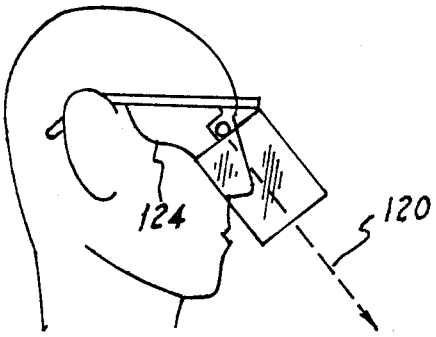
FIG. 10 is a diagrammatic side view illustrating a still further embodiment of the invention.

Finally, FIG. 10 illustrates an instance in which the head may be held erect while the eyes and optical axis lines are directed downwardly toward a target along dotted line 120. Although the head position is exaggerated for purposes of illustration, this position is used by some golfers to keep their chin up and out of the way of their shoulder on the backswing. In this instance, the forward, oblique portion of the opaque panel 122 must be slanted downwardly to properly direct the eyes to the target. A rearwardly extending panel portion 124 and inwardly extending auxiliary panel portions may also be used to block out visual distractions from the side and from above the optical axis line.

It should be noted that although a frame and the user's own eyeglasses have been described as supports for my invention, with novel and particularly useful hardware associated therewith, other supports such as inverted "U" headbands and associated hardware, horizontal headbands, etc. may also be used as supports.

There has thus been disclosed a unique performance enhancement apparatus or training aid which has been successfully used experimentally. However, the forms of the invention herein shown and described are to be taken as illustrative only, and changes in the shape, size and arrangement of the components may be made without departing from the spirit and scope of the invention.

I claim:

1. An assembly for directing user's eyes to a target and enabling concentration to be practiced and maintained, which is particularly useful in sports activities and the like, comprising:

(a) a pair of opaque panels adapted to be supported at eye level on the head of a user, with the panels to be disposed on opposite sides of the user's head adjacent to and alongside of each eye, (b) each said panel extending forward from a position substantially even with its adjacent eye and also extending obliquely inwardly toward and directed commonly with the optical axis line of the adjacent eye when the user's eyes are focused on a target, thereby directing the user's eyes to the target focal point and discouraging movement of the head which would move the eyes away from said focal point, and (c) a support adapted to be placed on the user's head; and (d) means for securing said panels to said support.

2. An assembly as defined in claim 1 in which each said panel's oblique extension is of a first configuration of a length and an angle to define a desired sight line when the user'eyes are focused on a target whereby the sight lines of the two panels converge at a line bisecting the angle formed by the optical axis lines of the user's eyes.

3. An assembly as defined in claim 2 in which each said panel's oblique extension is of a second configuration of a length and an angle to define a sight line whereby said sight lines of the two panels converge at the target.

4. An assembly as defined in claim 2 in which each panel's oblique extension is of a third configuration of a length and an angle to define a sight line whereby said sight lines of the two panels converge on said bisecting line between the target and the user's eyes.

5. An assembly as defined in claim 2 in which each said panel's oblique extension is of a fourth configuration of a length and an angle to define a sight line whereby said sight lines of the two panels coverge on said bisecting line after said bisecting line extends through the target.

6. An assembly as defined in claim 1 which further includes an auxiliary opaque panel member extending inwardly from each said first-mentioned panel toward the user's head to block visual distractions above the eye level of the user.

7. An assembly as defined in claim 1 in which each opaque panel member also extends rearwardly to block peripheral visual distractions.

8. An assembly as defined in claim 1 in which each opaque panel has an arcuate cross-section curving around an adjacent optical axis line to further reduce visual distractions above and below the optical axis lines of the eyes in addition to distractions from the sides.

9. An assembly as defined in claim 1 which further includes frame support means for holding said panels in said eye adjacent positions, including (a) a bridge section adapted to rest on the user's nose, and (b) temple pieces pivotally attached to and extending rearwardly from each end of said bridge section and adapted to rest on the user's ears, said bridge section and temple pieces cooperating to retain the frame support means on the user's head.

10. An assembly as defined in claim 9 in which each opaque panel is secured to its corresponding temple piece so that said panels are moved into a storage position when said temples are pivoted toward each other to a closed position next to said bridge section.

11. An assembly as defined in claim 1 in which each opaque panel includes means for adjustably securing each panel to a frame support means, thereby enabling panel line of sight adjustment to accommodate a change of users or a change of activity which makes a different panel line of sight desirable.

12. An assembly as defined in claim 11 in which said adjustable securing means includes a first pivotal means for connecting a panel to a support, and a second pivotal means for connecting the panel to the support which includes means for selectively securing the panel in a desired pivoted position of said first pivotal means with respect to the support, thereby enabling retention of the panel in a selected panel line of sight position.

13. An assembly as defined in claim 1 in which said panel securing means includes means for removably securing each panel to a pair of the user's eyeglasses.

14. An assembly as defined in claim 13 in which said panel removable securing means includes means for adjusting the position of said panels to enable panel line of sight adjustment to accommodate different users or a different activity.

15. An assembly as defined in claim 14 in which said adjusting means includes a first pivotal means for connecting a panel to a pair of glasses, and a second pivotal means for connecting the panel to the glasses which includes means for selectively securing the panel in a desired pivoted position of said first pivotal means with respect to the pair of glasses, thereby enabling retention of the panel in a selected panel line of sight position.

16. Apparatus for directing user's eyes to a target for use in sports or other activities requiring concentration on the target, comprising:

(a) a frame having a centrally disposed bridge section adapted to rest on a user's nose, and temple pieces extending from each side of said bridge section and adapted to rest on the user's ears, (b) an opaque panel attached to each side of said frame, each panel having a first portion extending forward from a position substantially even with the adjacent eye of the user, and a second portion extending to the rear, (c) each said panel forward portion being positioned obliquely inwardly toward and aligned with the optical axis line of the adjacent eye when the user's eyes are focused on a target, and (d) an auxiliary opaque panel member extending inwardly toward the user's head, the panels thereby blocking visual distractions while directing the user's eyes toward the target.

17. An assembly for attachment to a user's eyeglasses and directing user's eyes to a target, comprising:

(a) a pair of opaque panels to be attached on opposite sides of a pair of glasses, (b) each said panel having a first portion extending forwardly from a position substantially even with an adjacent eye of a user and a second portion extending to the rear of that adjacent eye when the panel is mounted on the pair of glasses, (c) each forward panel portion also extending obliquely inwardly toward and aligned with the optical axis line of the adjacent eye when the user's eyes are focused on a target, (d) an auxiliary opaque panel member extending inwardly toward the user's head, the combination of panels thereby blocking visual distractions while directing the user's eyes toward the target, and (e) means for removably securing each panel combination to a pair of the user's eyeglasses.

* * * * *